US008302739B2

(12) United States Patent
Pohlmann et al.

(10) Patent No.: US 8,302,739 B2
(45) Date of Patent: Nov. 6, 2012

(54) BRAKE DEVICE FOR A LIFT CAR

(75) Inventors: Andreas Pohlmann, Hamburg (DE); Bernward Bayer, Rödermark (DE); Andreas Emmerich, Oberursel (DE); Karl-Hermann Tegge, Königstein (DE); Stefan Johannes Schmitt, Eltville (DE); Johann Jungbecker, Badenheim (DE); Georg Halasy-Wimmer, Vaihingen (DE); Steffen Grundmann, Bonstetten (CH); Gert Silberhorn, Merlischachen (CH); Hans Kocher, Udlingenswil (CH); Michael Stübli, Buchrain (CH)

(73) Assignee: Continental Teves AG & Co. oHG (DE)

( * ) Notice: Subject to any disclaimer, the term of this patent is extended or adjusted under 35 U.S.C. 154(b) by 494 days.

(21) Appl. No.: 12/520,559

(22) PCT Filed: Dec. 19, 2007

(86) PCT No.: PCT/EP2007/064204

§ 371 (c)(1),
(2), (4) Date: Oct. 21, 2009

(87) PCT Pub. No.: WO2008/080847

PCT Pub. Date: Jul. 10, 2008

(65) Prior Publication Data

US 2010/0038184 A1 Feb. 18, 2010

(30) Foreign Application Priority Data

Jan. 5, 2007 (EP) ..... 07100189
Apr. 13, 2007 (DE) ..... 10 2007 017 902

(51) Int. Cl.
*B66B 1/32* (2006.01)

(52) U.S. Cl. ..... 187/288; 187/356; 187/370; 187/379

(58) Field of Classification Search ..... 187/241, 187/242, 287, 304, 306, 307, 356, 364, 367, 187/368, 369, 376, 377–379, 391–393, 288
See application file for complete search history.

(56) References Cited

U.S. PATENT DOCUMENTS

| | | | | | |
|---|---|---|---|---|---|
| 483,145 | A | * | 9/1892 | Giles | 187/360 |
| 1,124,804 | A | * | 1/1915 | Remjas | 187/365 |
| 1,129,536 | A | * | 2/1915 | Barash | 187/365 |
| 4,469,198 | A | * | 9/1984 | Crump | 182/141 |
| 5,353,895 | A | * | 10/1994 | Camack et al. | 187/369 |
| 5,648,644 | A | | 7/1997 | Nagel | |
| 6,032,763 | A | * | 3/2000 | Richter et al. | 187/377 |
| 6,374,953 | B1 | * | 4/2002 | Casas | 187/399 |
| 7,650,969 | B2 | * | 1/2010 | Monzon et al. | 187/300 |
| 7,896,139 | B2 | * | 3/2011 | Syrman et al. | 188/44 |

(Continued)

FOREIGN PATENT DOCUMENTS

DE 37 39 654 A1 6/1989

(Continued)

*Primary Examiner* — Anthony Salata
(74) *Attorney, Agent, or Firm* — RatnerPrestia

(57) ABSTRACT

A lift car with a brake device which is arranged in the region of the lift car for holding and braking the latter; the brake device includes a brake unit which can interact with a brake rail, an actuating device which can generate an actuator force, and a connector which connects the actuating device to the brake unit in a force-active manner in order to transmit the actuator force, wherein the brake unit is in its open position in the unloaded position.

12 Claims, 3 Drawing Sheets

U.S. PATENT DOCUMENTS

| | | | | |
|---|---|---|---|---|
| 8,020,671 | B2 * | 9/2011 | Kocher et al. | 187/351 |
| 8,113,319 | B2 * | 2/2012 | Anttila et al. | 187/379 |
| 2003/0062224 | A1 | 4/2003 | Maury et al. | |
| 2008/0128218 | A1 * | 6/2008 | Gremaud et al. | 187/250 |
| 2010/0089705 | A1 * | 4/2010 | Grundmann et al. | 187/249 |
| 2011/0226560 | A1 * | 9/2011 | Husmann | 187/359 |
| 2011/0303494 | A1 * | 12/2011 | Studer | 187/359 |

FOREIGN PATENT DOCUMENTS

| | | | |
|---|---|---|---|
| DE | 3739654 | A1 * | 6/1989 |
| EP | 0 440 839 | A1 | 8/1991 |
| EP | 0 648 703 | A1 | 4/1995 |
| GB | 1 111 425 | | 4/1968 |

* cited by examiner

BRAKE DEVICE FOR A LIFT CAR

CROSS REFERENCE TO RELATED APPLICATIONS

This application is the U.S. national phase application of PCT International Application No. PCT/EP2007/064204, filed Dec. 19, 2007, which claims priority to German Patent Application No. DE102007017902.4, filed Apr. 13, 2007 and European Patent Application No. EP 07100189.5, filed Jan. 5, 2007, the contents of such applications being incorporated by reference herein.

BACKGROUND OF THE INVENTION

1. Field of the Invention

The invention relates to a lift car with a brake device which is arranged in the region of the lift car for holding and braking the lift car, a lift system having a lift car of this type and to a method for holding and braking a lift car of this type.

2. Description of the Related Art

A lift system serves essentially for the vertical transport of goods or persons. The lift system contains, for this purpose, one or more lift cars for receiving the goods or persons, said lift car being movable along a guide track. As a rule, the lift system is installed in a building, and the lift car transports goods or persons from and to various stories of this building. In a conventional version, the lift system is installed in a lift well of the building, and it contains, in addition to the lift car, carrying means which connect the lift car to a counterweight. The lift car is moved by means of a drive which acts selectively on the carrying means, directly on the lift car or on the counterweight. The guide track for guiding the lift car is often a guide rail which is fastened to the building or in the lift well. Lift systems of this type are equipped with brake systems which can hold the lift car at a story stop and/or brake and hold the lift car in the event of a fault. The brake system cooperates for braking purposes with a brake track which is usually integrated into the guide rail. Lift systems of this type can, of course, also be arranged outside the building, in which case the guide rails may be part of a scaffold. Conventional catching devices are not designed to be capable of holding the lift car in a holding position, for example for loading the lift car, since they can be put into operation again only by a service engineer.

EP0648703 discloses a brake device for a lift car, which brake device is arranged in the region of the lift car and can be used for holding and braking. The brake device shown there contains in this case a fluidic brake unit which can cooperate with a brake rail, an actuation device which can actuate the brake unit and a connection means which connects the brake unit force-actively to the brake unit. The actuation device is a hydraulic pressure station which is connected via hydraulic connection means to individual brake units and thereby actuates the hydraulic brake unit force-actively. Force-actively in this context means that a hydraulic pressure generated in the actuation device actively defines a pressure force, resulting in the brake unit, of brake linings against the brake rail. This solution uses hydraulic pressure generators. This is costly and complicated in terms of procurement and maintenance. Components of this type, moreover, are noise-intensive, and safety precautions have to be taken in order to limit the effects of leakages.

Moreover, nowadays, car brake devices are increasingly used in order, for example, to retain a lift car at a story stop during the loading operation or to correct a faulty behavior of the lift car quickly and smoothly.

SUMMARY OF THE INVENTION

An object of the invention, then, is to provide a brake device which, in the event of an operational irregularity of a lift car, can be used quickly and, after its use, can be brought into its position of readiness again quickly. At the same time, the device is to have low noise and simple application.

A lift car arranged in a lift well is equipped with a brake device for holding and braking the lift car. The brake device consists of a brake unit which, upon appropriate actuation, can cooperate with a brake rail. The brake device contains, further, an actuation device which can generate an actuator force FA and a connection means which connects the actuation device force-actively to the brake unit for the transmission of the actuator force FA. A force-active connection means that the brake unit generates a pressure force FN and consequently a resultant brake force which is defined by a brake friction coefficient and which is directly dependent on the actuator force FA. A low pressure force FN therefore gives rise to a small brake force, and a high actuator force FA gives rise to the correspondingly high pressure force FN. According to aspects of the invention, then, the connection means is a traction means, and the brake unit is designed in such a way that in the non-loaded position, that is to say when no actuator force FA prevails, it is in the open position. Open position means that the brake device or the brake unit does not brake. The traction means used is advantageously a traction cable, a drawbar or else a pull chain.

The advantage of this invention is that, in the event of operational irregularity of a lift car, the brake device can be used quickly by means of a mechanical connection means or the traction means and, after its use, can be brought back into its position of readiness again quickly. For this purpose, the brake unit is designed in such a way that it is in the open position when no actuator force FA prevails, and the connection means is formed by the traction means, since a rapid and reliable actuation and also, again, an easy resetting can thereby take place. Moreover, this device has very low noise, since, when the lift system is in operation, no pumps or the like have to be in operation. Further, the device has simple application, since it can easily be checked and understood by a specialist. This is due only to the fact that the principle of this brake device has been known and has proved successful for a long time in bicycles.

According to aspects of the invention, this brake device is arranged in the region of the lift car. Consequently, the brake device can simply be used for holding the lift car at a story, or the brake device can be braked in the event of an unexpected behavior of the lift car, for example if it suddenly slips away while the story access is open. Owing to the simple actuation, the brake device can simply be reset again. As a rule, the brake rail is an integral part of a guide rail on which the lift car is guided along. The brake device can also be mounted at any desired location. It may be mounted above the lift car or built under the lift car, or it may be integrated into the lift car structure, for example in a car roof, car floor or also in side walls.

In an advantageous version, the brake device has at least two brake units which are advantageously arranged at opposite boundary edges of the lift car and which cooperate in each case with a brake rail or guide rail. The actuation device generates an actuator force FA for actuating the brake units (9), this actuator force FA being transmitted essentially symmetrically to the brake units by connection means. The actuation device is accordingly arranged essentially centrally, in the middle between two brake units, in each case a first connection means being connected to a first brake unit and a second connection means being connected to a second brake unit.

This type of operation is advantageous since, because the brake units are arranged on both sides, the holding and brake forces are introduced essentially symmetrically into the lift car, and the actuation device may be arranged centrally, for example in the middle of a roof of the lift car. Checks are therefore simple to carry out.

Advantageously, a position of the actuation device is defined essentially by an equilibrium of the first and the second connection means. This affords the two brake units with an identical actuator force. Furthermore, a limitation means is provided, which, in the event of a failure by one of the connection means, limits a lateral displacement of the actuation device and thus maintains the actuator force FA in the remaining connection means. This increases the reliability of the brake device, since a residual brake force persists in spite of the failure of a connection means. If, for example, the brake force of the brake device is weighted with a safety factor of 2, holding would be ensured even in the event of the failure of one of the connection means. The failure of one of the connection means or contact of the actuation device with the limitation means may be monitored by means of a switch, and, if this state is established, maintenance may be initiated or the operation of the lift system may be restricted.

Advantageously, the brake unit contains a force step-up which converts the actuator force FA transmitted by the connection means into a pressure force FN and at the same time brings about an intensification of this pressure force FN. This is achieved, for example, by means of a lever mechanism which converts the actuator force FA into a pressure force FN via a toggle lever, via eccentrics or else via convex discs. With step-up or intensification means of this type, high force intensifications can be achieved. This is advantageous, since commercially available connection means, such as, for example, a Bowden cable assembly, can therefore be used as connection means.

In a variant of the invention, to generate the actuator force FA in the actuation device, a pull-tensioning device is used. The pull-tensioning device, when appropriately activated, pulls the first and the second connection means by joint control or relieves them. This takes place, for example, via a spindle mechanism which pulls tight or detensions one or both of the connection means with respect to the actuation device. The spindle mechanism is designed in such a way that the pull-tensioning device maintains its currently set position in the absence of a control signal or a supply energy. The supply energy supplies the drive of the spindle mechanism or of the actuation device with preferably electrical energy, and the control signal gives the control command to tension the connection means or to detension the connection means. The advantages are to be seen in that brake force determination takes place centrally in the common actuation device, and the actuator force is necessarily transmitted with equal action to the decentral brake units. Moreover, the selected pull-tensioning device ensures that a set state is maintained. The actuator force is transmitted essentially by traction. This makes it possible to use favorable traction means, such as, for example, a traction cable, a pull chain or a drawbar.

Advantageously, the actuation device contains a sensor for detecting the current actuator force FA, and this sensor is used selectively for control, regulation and monitoring. The sensor is, for example, a force-measuring sensor or a spring-loaded position sensor which detects a compression of the spring, via which the actuator force is transmitted, and the position sensor is correspondingly a measure of the actuator force. In the position sensor, for example, the positions are "actuator force reached" or "actuation device set", and the pull-tensioning device is controlled on the basis of these signals. Actual force or pressure sensors may, of course, also be used. The use of a sensor of this type is advantageous since a specific tensile force can be achieved independently of a state of wear, and, further, any deviations can be ascertained and communicated accordingly to a service station.

An advantageous extension affords the possibility of hanging the connection means around with a block and tackle. The actuator force FA transmitted from the connection means to the brake unit can thus be intensified according to a hang-around factor of the block and tackle. The holding or brake force required for a specific lift system can consequently be achieved.

The brake device can be activated quickly, or else as a precaution, and, after the reason for the fault has been eliminated, it can likewise be reset again quickly.

The brake device may be mounted on the lift car in addition to a catching device. This is advantageous since a known and safety-tested emergency brake system consequently protects the lift car against extreme faults, such as the failure of carrying means, and the task of the brake device can be aimed primarily at faults and/or use in the region of stops or in the vicinity of travel limitations, such as, for example, a lift well end or another lift car.

BRIEF DESCRIPTION OF THE DRAWINGS

Further refinements may be covered by the following exemplary embodiments. The invention is explained in more detail by means of an exemplary embodiment, in conjunction with the diagrammatic figures in which.

DETAILED DESCRIPTION OF THE PREFERRED EMBODIMENTS

Figure 1:
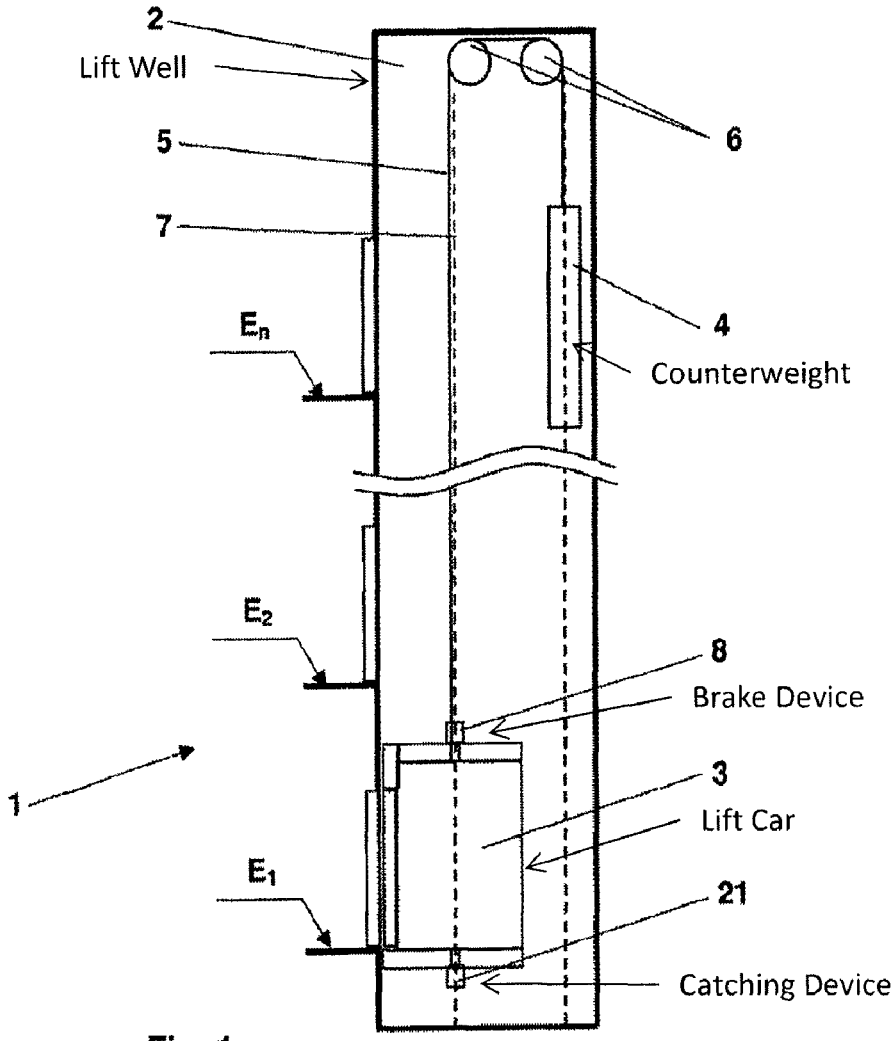
FIG. 1 shows a view of a lift system with a lift car and with the brake device arranged above the lift car.

Identically acting parts are given the same reference symbols in all figures. A possible overall arrangement of a lift system 1 is illustrated in FIG. 1. The lift system 1 shown contains a lift car 3 for receiving goods or persons. The lift car 3 is movable along a guide rail 7. The lift system 1 is installed in a building, and the lift car 3 transports goods or persons from and to various stories E1 . . . EN of this building. In a version illustrated here, the lift system 1 is installed in a lift well 2 of the building, and it contains, in addition to the lift car 3, carrying means 5 which connect the lift car 3 to a counterweight 4. The lift car 3 is moved by means of a drive 6 which acts on the carrying means 5. The guide track for guiding the lift car 3 is a guide rail 7 which is arranged fixedly in the building or in the lift well 2. The lift car 3 is equipped with a brake device 8 which can hold the lift car 3 in a holding position and/or can brake and hold the lift car 3 in the event of a fault. The holding position is normally a story stop. The brake device 8 cooperates for braking purposes with a brake rail 7 which, in the example illustrated, is integrated into the guide rail 7. Further, the lift car 3 illustrated in FIG. 1 is equipped with a catching device 21 which would brake the lift car 3 in the event of an extreme excess speed or even the failure of the carrying means.

Figure 2:
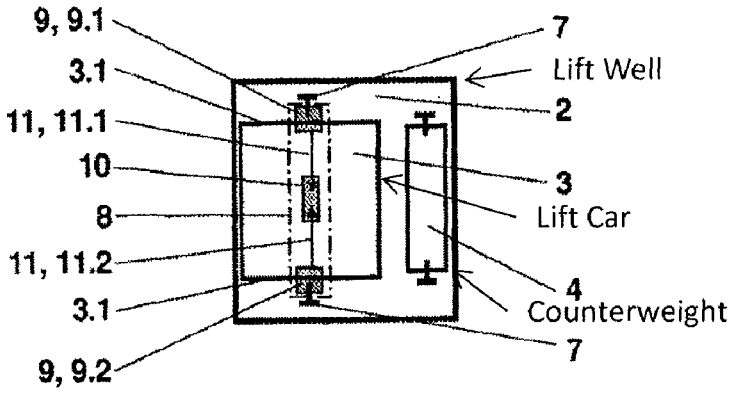
FIG. 2 shows a top view of the lift system according to FIG. 1.

FIG. 2 shows a top view of the lift car 3 of the version illustrated in FIG. 1. The brake device 8 consists of a first brake unit 9, 9.1 and of a second brake unit 9, 9.2. The brake units 9 are arranged in each case at opposite boundary edges 3.1 of the lift car 3, and they act there on the guide rail 7 which at the same time forms the brake rail. Further, the brake device 8 contains an actuation device 10 which is arranged essentially in the middle between the two brake units 9. The actuation device 10 is connected by connection means 11 or by a first connection means 11.1 and a second connection means 11.2 to the brake units 9 located on both sides. By the two connection means 11 being pulled together, the brake units 9 are acted upon synchronously with the same force. This means that the actuation device 10 hangs freely essentially in the direction of force. Fastening means, not illustrated, are, of course, present, which prevent a twisting of the actuation device 10, but at the same time allow an at most limited displacement in the direction of force in the connection means 11. This is necessary in order to allow different elongations in the connection means. The connection means 11 in the example illustrated are traction cables, such as are used, for example, for a Bowden cable assembly. Instead of traction cables, drawbars with articulated connection points or else a pull chain could, of course, also be used. However, the connection means is designed only to transmit a tensile force to the brake unit 9 and is a traction means.

Figure 3:
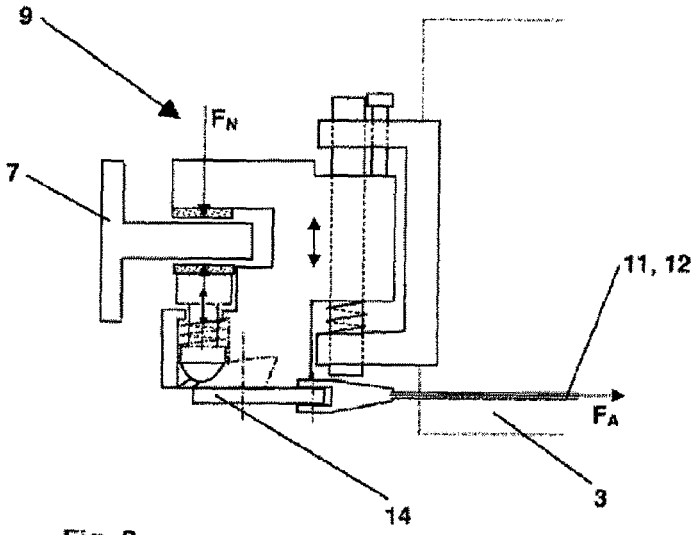
FIG. 3 shows a view of a first version of a brake unit with connection means.

FIG. 3 shows a possible version of the brake unit 9. In the example, a non-actuated brake is shown, which is connected in a known way to the lift car 3 via a floating mounting having a one-sided abutment. In the event of actuation, the connection means 11 or the traction cable 12 advances a movable brake lining via a force step-up lever 14 and consequently firmly clamps the guide rail 7. As a result of this clamping force or pressure force FN, a brake force arises by means of which the lift car 3 is braked or held. The brake unit is actuated force-actively by the connection means 11, that is to say, without an actuator force FA transmitted by the connection means 11, the brake unit is in the open or non-braking position.

Figure 5:
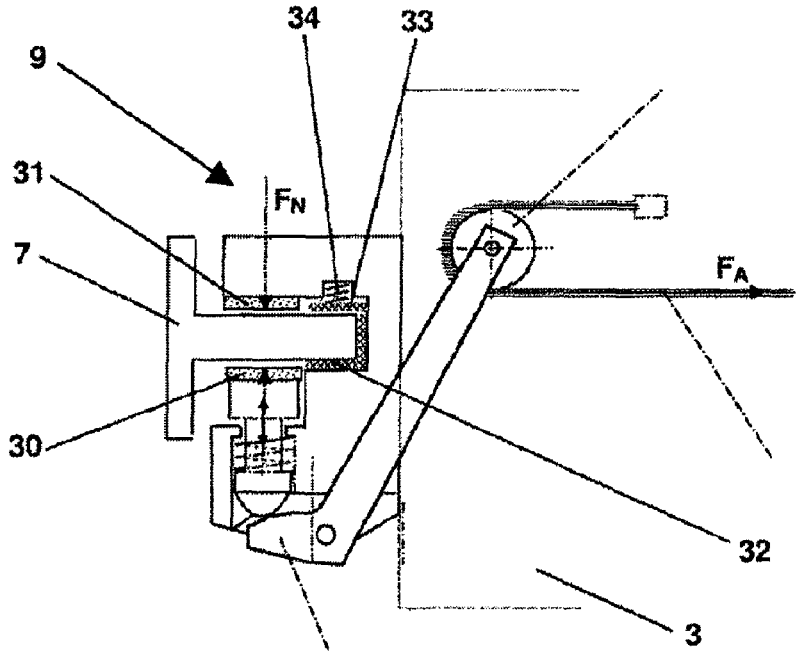
FIG. 5 shows a view of another version of a brake unit with connection means (10)

FIG. 5 shows another version of the brake unit 9. In this example, a likewise non-actuated brake is shown and which is connected fixedly to the lift car 3. In the event of actuation, the connection means 11 or the traction cable 12 advances the movable brake lining via a force step-up lever 14 and consequently firmly clamps the guide rail 7. As a result of this pressure force FN, a brake force arises by means of which the lift car 3 is braked or held. By means of a step-up lever 14 of this type, mechanical force step-ups of, for example, 1:10 can be achieved. Moreover, in the example illustrated, a further force step-up is provided, in that the traction cable 12 is hung around a block and tackle in a ratio of 2:1. Consequently, by means of this overall arrangement, an actuator force FA can be intensified by the factor 2×10. The resultant pressure force FN thus amounts to twenty times the value of the actuator force. FN=20×FA. The intensification factor is given as an example. Of course, using various lever geometries, slot shapes, eccentric pressing mechanisms or convex disks, and also the variability of the deflection arrangements on the connection means, the optimal intensifications can be determined, taking into account an actuation travel. In this example, the brake unit 9 at the same time assumes a guidance of the lift car 3, at least in the region of the brake unit 9. As illustrated, the brake unit 9 is connected fixedly to the lift car 3. A fixed guide lining 32 is arranged on the side of the movable or advanceable brake plate 30. This fixed guide lining 32 takes over customary guidance forces during normal operation. An elastically mounted guide lining 33 is arranged on the side of the fixed brake lining 31. An elastic mounting 34 of the guide lining 33 is dimensioned in such a way that customary guidance forces, such as appear during normal operation, do not result in any compression of the elastic guide lining 33.

If, then the brake unit 9 is advanced, that is to say the movable brake lining 30 is advanced by means of the actuator force FA, the movable brake lining 30 is pushed in front of the fixed guide lining 32 and subsequently presses the opposite elastic guide lining 33 back against the elastic mounting 34, until the fixed brake lining 31 comes to bear against the guide rail 7 and can then exert its braking action. This type of design of the mounting is not mandatory. Other versions, such as the floating mounting illustrated in FIG. 3, may likewise be used.

Figure 4:
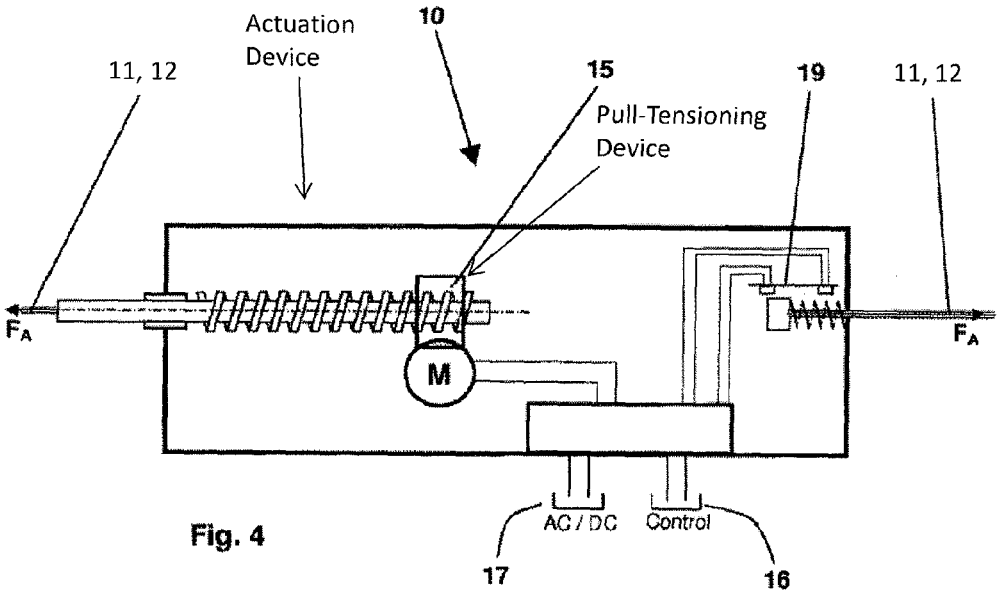
FIG. 4 shows a view of a first version of an actuation device with connection means.

FIG. 4 shows an example of an actuation device 10. The first connection means 11.1 is illustrated by means of a pull-tensioning device 15 which consists of a spindle and spindle motor and which can pull the first connection means 11.1 into the actuation device 10. The opposite second connection means 11.2 is connected to the actuation device 10 via a force-measuring device 19. A tension force FA generated by the pull-tensioning device 15 is thus transmitted symmetrically to the brake units 9 (not illustrated in FIG. 4) via the connection means 11.1, 11.2. The pull-tensioning device 15 is controlled by means of a sensor or force-measuring device 9. That is to say, when the actuator force FA is built up, the pull-tensioning device 15 is switched off when a set force point is reached, with the result that the actuator force achieved is maintained, and, when the actuator force is released, the pull tension is broken down until the corresponding no-force information is measured. The pull-tensioning device 15 illustrated is selected in such a way that, in the event of a failure of an energy supply 17, which may be a mains power source AC or a direct voltage source DC, or in the event of the failure of a control signal "control", an actuator force FA currently reached is maintained. This is achieved, for example, by means of an appropriate choice of a spindle pitch.

Figure 6:
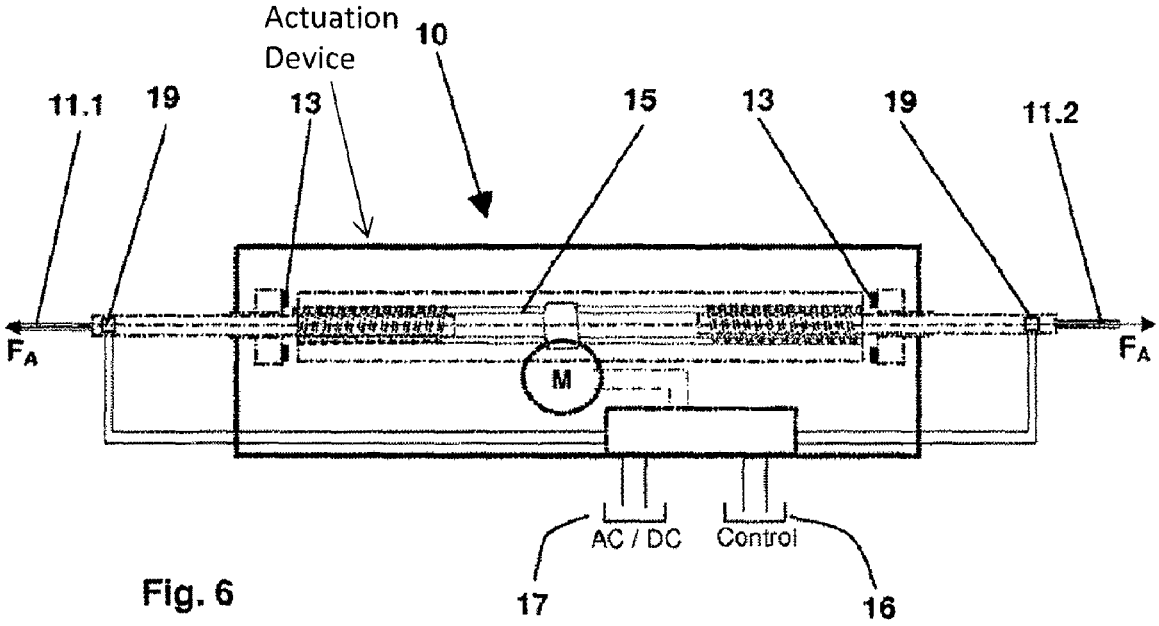
FIG. 6 shows a view of another version of an actuation device with connection means.

FIG. 6 shows another example of an actuation device 10. The first and second connection means 11.1, 11.2 are connected together by means of a pull-tensioning device 15 consisting of a spindle with contradirectional thread pitches. By the spindle being actuated by means of a spindle motor, the two connection means 11 are tensioned with respect to one another. By means of force sensors 19, the current actuator force FA can be measured and the pull-tensioning device 15 can be controlled correspondingly. In this version, in the event of a failure of one of the connection means 11, the spindle butts against one of the limitation means 13, and the actuator force can nevertheless be built up in the remaining connection means 11. Since the actuator force FA is measured in both connection means 11, a fault of this type can be detected quickly and corresponding repairs can be initiated. An actuation device of this type can typically furnish an actuator force FA of about 1500N. Thus, with the force intensification in the force step-up 14 by the factor ten, a pressure force FN of about 15 0000N is obtained in the case of a direct tie-up of the connection means 11 to the brake unit 9, as illustrated in FIG. 3. If two brake units 9 are used, as is clear in FIG. 1, and an assumed static friction coefficient of 0.3, a total holding force of 2×2×15 000×0.3=18 000N is correspondingly obtained as a result. Using a safety factor of 2 for holding a lift car having a 125% load and for 50% balancing, this therefore corresponds to a lift car with a permissible transport load of about 1200 kg. This rating is just one example. Other safety factors and balancings and also other ratings of actuation devices 10, force step-ups 14 or brake units 9, etc. are, of course, possible.

As is clear in FIG. 1, as a rule, existing catching device 21 is still present. The rating criteria for the brake device 8 are consequently reduced. Of course, the brake device 8 may also be used as a safety brake, for example using redundant energy supplies and controls.

With the knowledge of the present invention, the lift specialist can vary the set forms and arrangements in many different ways. For example, the pull-tensioning device 15 shown may also be designed with linear motors or winding motors or the like, instead of the spindle mechanisms, or the connection means 11 may be deflected with respect to the actuation device 10.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

The invention claimed is:

1. A lift car with a brake device which is arranged in a region of the lift car for holding and braking the lift car, the brake device comprising:

a brake unit which can cooperate with a brake rail, an actuation device which can generate an actuator force, and a connection means which connects the actuation device force-actively to the brake unit for the transmission of the actuator force, wherein, in the non-loaded position, the actuator force is not generated, and the brake unit is in an open position, and wherein the connection means is a traction means.

2. The lift car as claimed in claim 1, wherein the brake device has at least two brake units which are arranged at opposite boundary edges of the lift car and which cooperate in each case with a brake rail, and the actuation device generates an actuator force for actuating the brake units, said actuator force being transmitted essentially symmetrically to the brake units by connection means and the actuation device being arranged essentially centrally, in the middle between two brake units, in each case a first connection means being connected to a first brake unit and a second connection means being connected to a second brake unit.

3. The lift car as claimed in claim 2, wherein a position of the actuation device is defined by an equilibrium of the first and of the second connection means, in the event of the failure of one of the connection means a limitation means maintaining the actuator force in the remaining connection means.

4. The lift car as claimed in claim 1, wherein the brake unit contains a force step-up which converts the actuator force transmitted by the connection means into a pressure force and at the same time brings about an intensification of said pressure force.

5. The lift car as claimed in claim 2, wherein the actuation device contains a pull-tensioning device which, to generate the actuator force, pulls together the first and the second connection means under control or relieves said connection means, the pull-tensioning device maintaining its currently set position in the absence of a control signal or of supply energy.

6. The lift car as claimed in claim 1, wherein the connection means is hung around with a block and tackle, and the actuator force transmitted from the connection means to the brake unit is intensified according to a hang-around factor of the block and tackle.

7. The lift car as claimed in claim 1, wherein the actuation device contains a sensor for detecting a current actuator force, and the sensor is configured to control, regulate or monitor the operation of the actuation device based on the detected actuator force.

8. The lift car as claimed in claim 1, wherein the brake device is mounted on the lift car and a catching device.

9. A lift system having a lift car as claimed in claim 1, wherein the lift car is movable in a lift well.

10. A lift car with a brake device which is arranged in a region of the lift car for holding and braking the lift car, the brake device comprising:

a mechanical brake unit, an actuation device for generating an actuator force, and a connection means which connects the actuation device force-actively to the brake unit for the transmission of the actuator force, said connection means being arranged in a region of the lift car, a pressure force which corresponds to the actuator force being generated in the brake unit, wherein, in a non-loaded position, the actuator force is not generated, and the brake unit is moved into its open position, and wherein the connection means is a traction means.

11. The lift car as claimed in claim 1, wherein the actuation device is an electrically drivable actuation device comprising a motor.

12. The lift car as claimed in claim 10, wherein the actuation device is an electrically drivable actuation device comprising a motor.

* * * * *